US010220358B2

(12) United States Patent
Morton

(10) Patent No.: US 10,220,358 B2
(45) Date of Patent: Mar. 5, 2019

(54) MIXING DEVICE FOR JOINT COMPOUND

(71) Applicant: Buddy Tools, LLC, Sulphur Springs, OH (US)

(72) Inventor: Ronald J. Morton, Sulphur Springs, OH (US)

(73) Assignee: Buddy Tools, LLC, Sulphur Springs, OH (US)

( * ) Notice: Subject to any disclaimer, the term of this patent is extended or adjusted under 35 U.S.C. 154(b) by 242 days.

(21) Appl. No.: 15/134,704

(22) Filed: Apr. 21, 2016

(65) Prior Publication Data

US 2016/0310917 A1 Oct. 27, 2016

Related U.S. Application Data

(60) Provisional application No. 62/150,582, filed on Apr. 21, 2015.

(51) Int. Cl.
*B01F 7/00* (2006.01)
*B01F 13/00* (2006.01)

(52) U.S. Cl.
CPC ..... *B01F 7/00033* (2013.01); *B01F 7/00583* (2013.01); *B01F 13/0028* (2013.01)

(58) Field of Classification Search
CPC ..... B01F 7/00583; A23G 9/12; A23G 9/224; A47J 43/0711

(Continued)

(56) References Cited

U.S. PATENT DOCUMENTS 132,483 A * 10/1872 Muth ..... B01F 13/002 366/325.3
5,865,539 A * 2/1999 Rogers ..... B01F 7/00583 366/129

(Continued)

OTHER PUBLICATIONS

Goldblatt, Mud Mixer, 8 In Dia, 30 In Shaft, 7/16In G15303-G2245801, available at: https://www.zoro.com/goldblatt-mud-mixer-8-in-dia-30-in-shaft-716-in-g15303/i/G2245801/, Apr. 21, 2015.

(Continued)

*Primary Examiner* — Tony G Soohoo
*Assistant Examiner* — Elizabeth Insler
(74) *Attorney, Agent, or Firm* — Renner, Otto, Boisselle & Sklar, LLP

(57) ABSTRACT

A mixing device including a blade with radially outwardly extending arms and/or with a longitudinally extending wall with an elliptical cross-section. The elliptical cross-section may synergistically provide enhanced mixing and enhanced durability of the blade compared to previously known joint compound mixers. For example, the elliptical cross section may provide structural support to the radially outwardly extending arms and/or the longitudinally extending walls while allowing the radially outwardly extending arms and/or the longitudinally extending walls to cut through and spread joint compound. The structural support may allow the blade to be made of a plastic material. For example, the blade may be made of acrylonitrile butadiene styrene (ABS). Making the blade out of plastic may reduce scratching and degradation of the container that holds the joint compound during mixing, compared to previously known drywall mixers made of metal.

20 Claims, 7 Drawing Sheets

(58) Field of Classification Search
USPC ..... 366/69, 129, 605
See application file for complete search history.

(56) References Cited

U.S. PATENT DOCUMENTS

| | | | | |
|---|---|---|---|---|
| D654,315 | S * | 2/2012 | Benold | D7/405 |
| 2011/0116341 | A1* | 5/2011 | Obersteiner | A47J 43/0711 366/344 |

OTHER PUBLICATIONS

Hardware World, MarshallTown 819" Quik-Mix Mud Mixer, available at: https://web.archive.org/web/20100113204205/http://www.hardwareworld.com/819-Quick-Mix-Paint-Mixer-p9W7CCK.aspx, Jan. 13, 2010.

Advance Equipment Mfg. Co.—Manufacturing Quality Tools Since . . . , available at: https://web.archive.org/web/20111023104529/http://www.advance-equipment.com/Advance-Easy-Mixer-Drywall-Mixers.php, Oct. 23, 2011.

Joint Compound Mixer Blade, Wal-Board 43-001 24" Quick Mixer, available at: https://web.archive.org/web/20130620090835/http://www.homedepot.com/p/Wal-Board-Tools-24-in-Quick-Mixer-43-001/100390691?#.VxfCwEe2XEY, Jun. 20, 2013.

* cited by examiner

MIXING DEVICE FOR JOINT COMPOUND

RELATED APPLICATIONS

This application claims the benefit of U.S. Provisional Application No. 62/150,582 filed Apr. 21, 2015, which is hereby incorporated herein by reference.

FIELD OF INVENTION

The present invention relates generally to mixing devices, and more particularly to mixing devices for joint compound, paint, ceramic tile thin set, or epoxy coatings.

BACKGROUND

Joint compound (also referred to as "drywall compound") is typically a pre-mixed paste, a mud compound, or a white powder of primarily gypsum dust mixed with water. The mud is generally applied in conjunction with paper or fiber joint tape to seal joints between sheets of drywall to create a seamless base for painting a surface formed by the drywall sheets.

The joint compound often comprises a combination of many materials that need to be homogenized to ensure proper functioning of the joint compound once applied to a drywall joint. For example, the joint compound may comprise water, limestone, expanded perlite, ethylene-vinyl acetate polymer, attapulgite, and other ingredients.

Previously known joint compound mixers have been used to mix joint compound to homogenize the various materials of the joint compound. However, joint compound is generally carried in plastic buckets and is often highly viscous and dense, which has required previously known drywall heavy duty mixers to be made of strong materials, such as metal, to effectively mix joint compound.

SUMMARY OF INVENTION

A mixing device in accordance with the present invention includes a blade with radially outwardly extending arms and/or with a longitudinally extending wall with an elliptical cross-section. The elliptical cross-section may synergistically provide enhanced mixing and enhanced durability of the blade compared to previously known joint compound mixers. For example, the elliptical cross section may provide structural support to the radially outwardly extending arms and/or the longitudinally extending walls while allowing the radially outwardly extending arms and/or the longitudinally extending walls to cut through and spread joint compound.

The structural support may allow the blade to be made of a plastic material. For example, the blade may be made of acrylonitrile butadiene styrene (ABS). Making the blade out of plastic may reduce scratching and degradation of the container that holds the joint compound during mixing, compared to previously known drywall mixers made of metal. The plastic blade may reduce scratching of the surfaces of the container during mixing, compared to previously known drywall mixers.

The entire outer surface of the blade may have a smooth plastic finish, such as a smooth ABS. The smooth finish may allow the outer surface of the blade to repel joint compound for easier cleaning of the blade, compared to previously known drywall mixers.

According to one aspect of the invention, a mixing device includes a blade extending along a longitudinal axis, including: a first radially extending arm extending from a first radially central portion of the blade, wherein the first radially extending arm has an elliptical cross-section, and wherein the first radially extending arm includes a trailing edge, a leading edge, and a central portion between the trailing edge and the leading edge, a second radially extending arm extending from a second radially central portion of the blade that is axially spaced from the first radially central portion, wherein the second radially extending arm has an elliptical cross-section, and wherein the second radially extending arm includes a trailing edge, a leading edge, and a central portion between the trailing edge and the leading edge, a first axially extending wall extending from a radially outer end of the first radially extending arm to a radially outer end of the second radially extending arm, wherein the first axially extending wall has an elliptical cross-section, and wherein the first axially extending wall includes a trailing edge, a leading edge, and a central portion between the trailing edge and the leading edge, a third radially extending arm extending from the first radially central portion of the blade, wherein the third radially extending arm has an elliptical cross-section, and wherein the third radially extending arm includes a trailing edge, a leading edge, and a central portion between the trailing edge and the leading edge, a fourth radially extending arm extending from the second radially central portion of the blade, wherein the fourth radially extending arm has an elliptical cross-section, and wherein the fourth radially extending arm includes a trailing edge, a leading edge, and a central portion between the trailing edge and the leading edge, and a second axially extending wall extending from a radially outer end of the third radially extending arm to a radially outer end of the fourth radially extending arm, wherein the second axially extending wall has an elliptical cross-section, and wherein the second axially extending wall includes a trailing edge, a leading edge, and a central portion between the trailing edge and the leading edge, wherein each leading edge is able to cut through joint compound to be mixed, or any other fluid to be mixed, when the blade is rotated about the longitudinal axis in a first circumferential direction, and at least a portion of each leading edge is thinner than each adjacent central portion.

The foregoing and other features of the invention are hereinafter described in greater detail with reference to the accompanying drawings.

DETAILED DESCRIPTION

Figure 1:
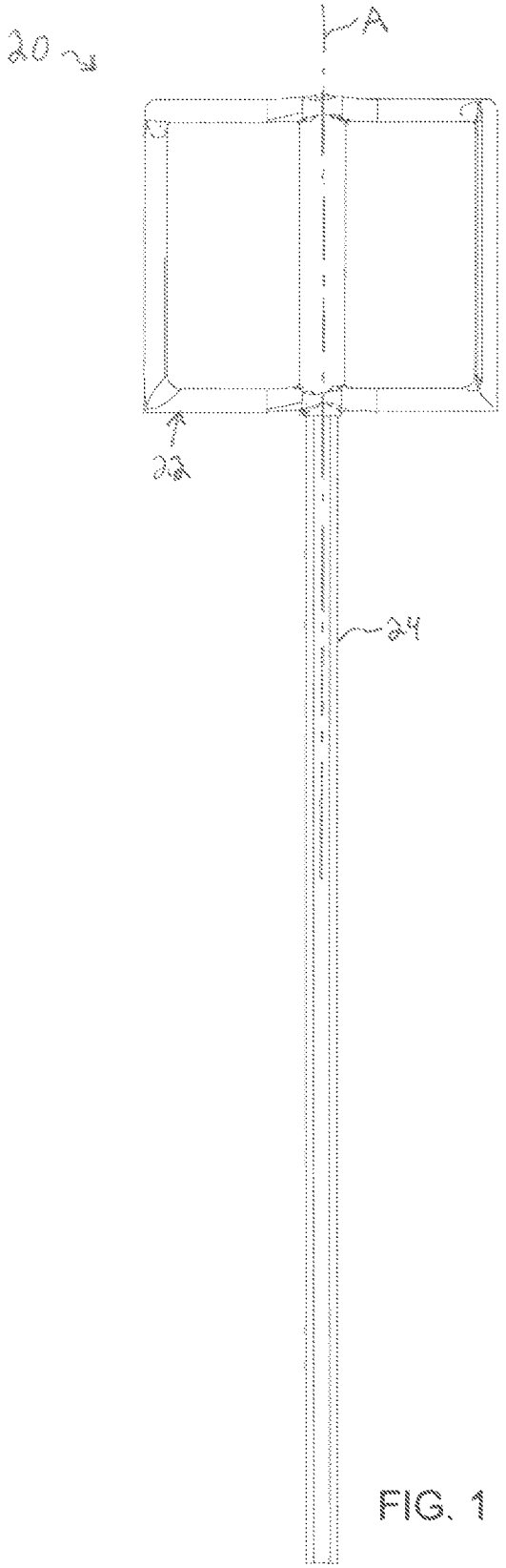
FIG. 1 is a front view of an exemplary mixing device.
Figure 2:
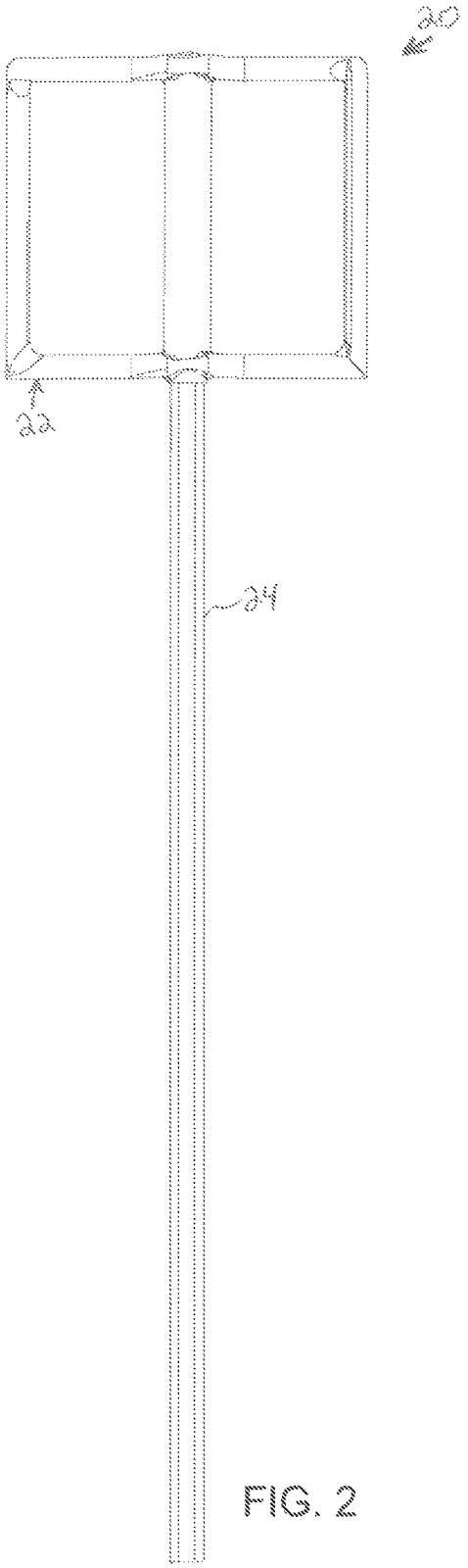
FIG. 2 is a rear view of the mixing device of FIG. 1.
Figure 3:
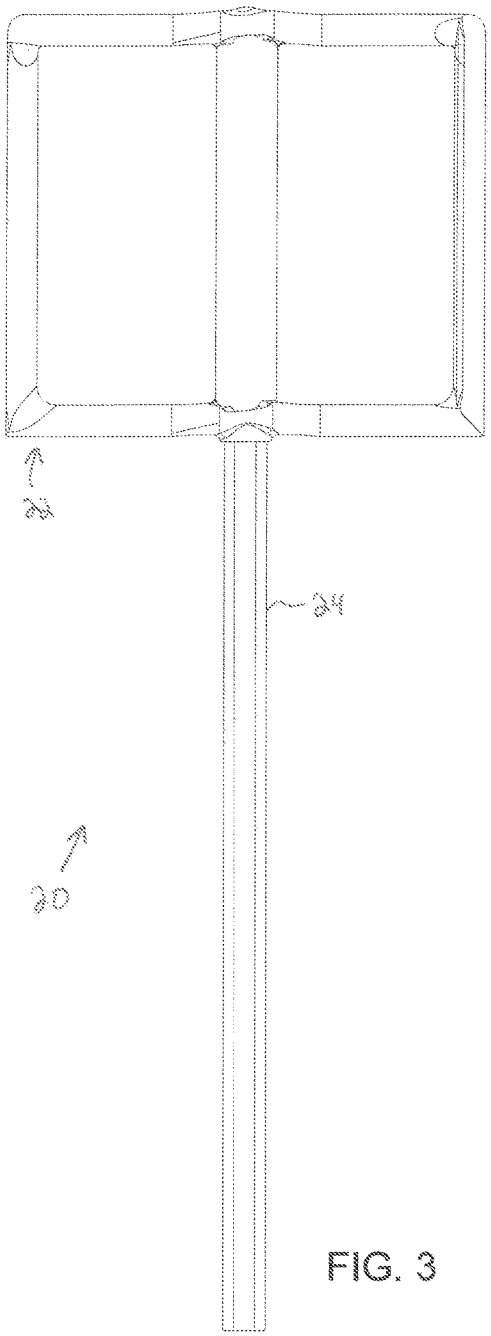
FIG. 3 is a partial front view of the mixing device of FIG. 1.
Figure 4:
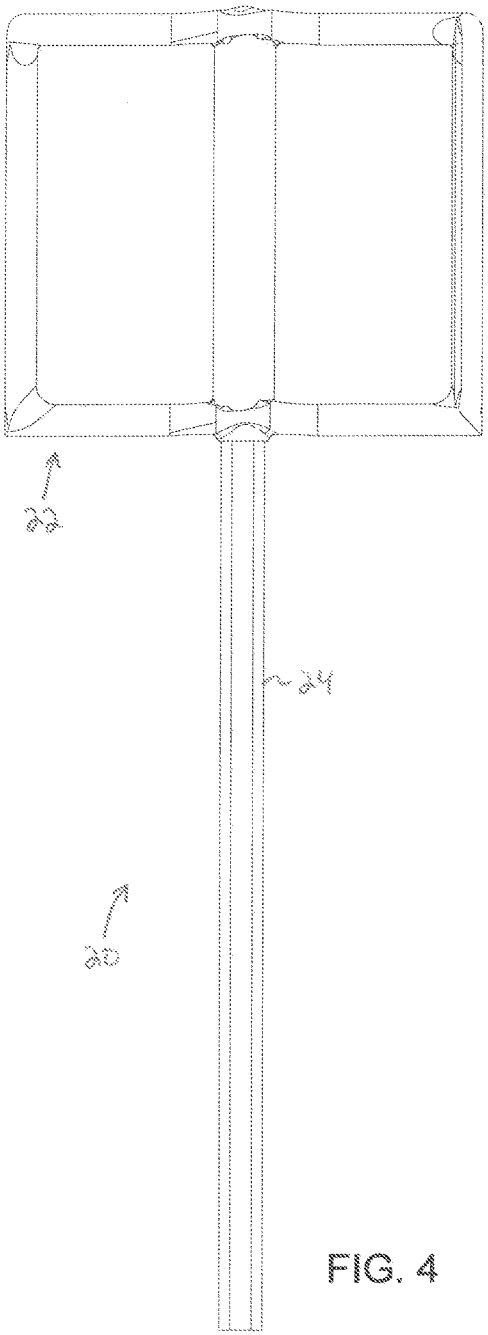
FIG. 4 is a partial rear view of the mixing device of FIG. 1.

The principles of this present application have particular application to mixing joint compound, and thus will be described below chiefly in this context. It will of course be appreciated, and also understood, that principles of this invention may be applicable to other materials.

Referring now in detail to the drawings, and initially to FIGS. 1-4, a mixing device is designated generally by reference numeral 20. The mixing device 20 may include a blade 22 that extends along a longitudinal axis A and a shaft 24 fixed to the blade 22. The blade 22 may be fixed to the shaft 24, for example by a molded connection.

The shaft 24 may be concentric with the longitudinal axis A and may have a length along the longitudinal axis A that is greater than a length of the blade 22 along the longitudinal axis A. For example, drive end of the shaft 24 may extend through most of the blade 22 and a driven end of the shaft 24 opposite the drive end may extend away from the blade 22 more than three lengths of the blade 24 to allow a driver (not shown) to attach to the opposite end of the shaft 24 to drive the shaft 24. In an embodiment, the shaft may be any suitable length to allow the driver to driver the drive shaft.

The shaft 24 may have a hexagonal cross-section for engaging with any suitable driver (not shown), such as an electrically powered cordless drill, to drive the blade 22 via the shaft 24. In an embodiment, the shaft may have any suitable cross-section that is engageable with the driver. For example, an end of the shaft opposite the blade may have a cross-section that is square, round, octagonal, or any other suitable shape.

Figure 5:
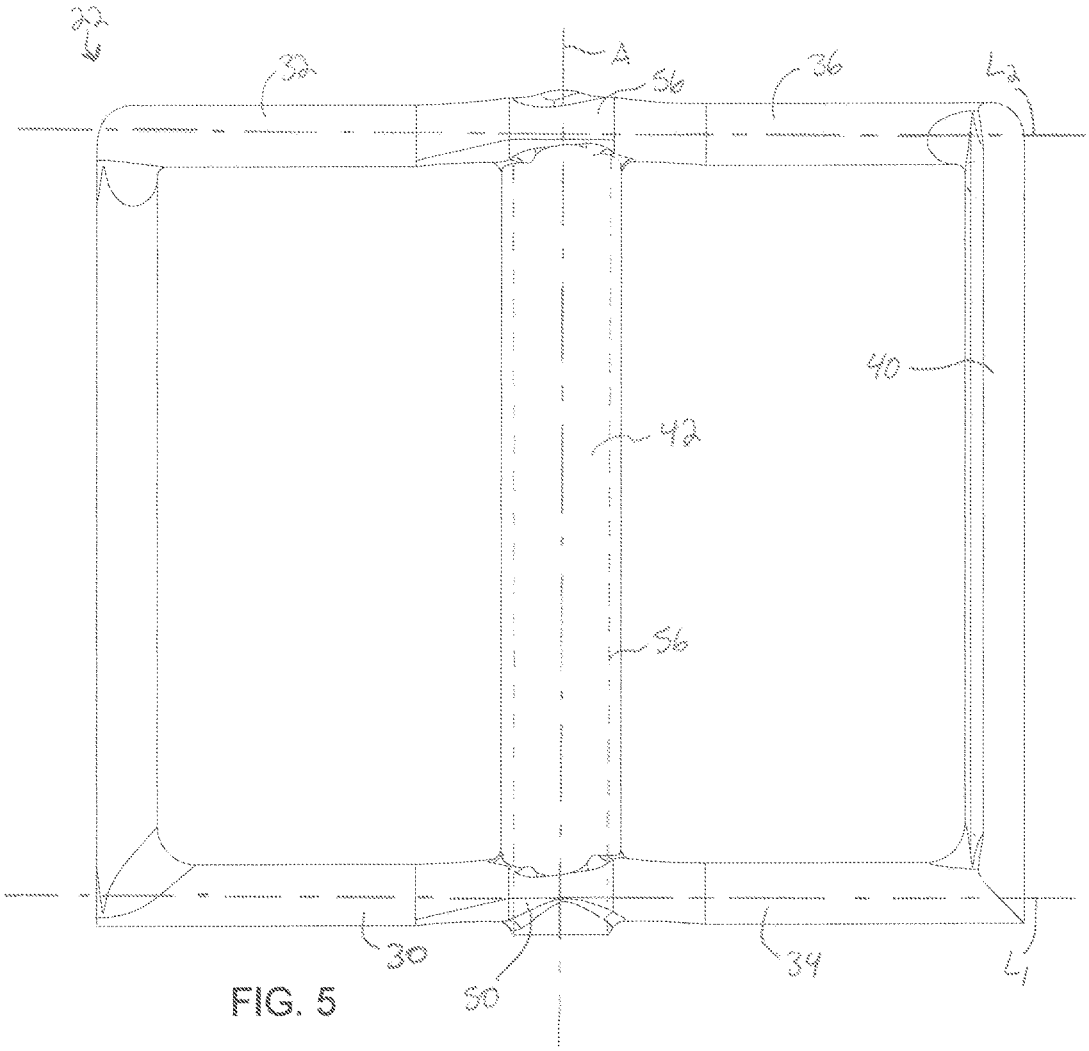
FIG. 5 is a front view of a blade of the mixing device of FIG. 1.
Figure 6:
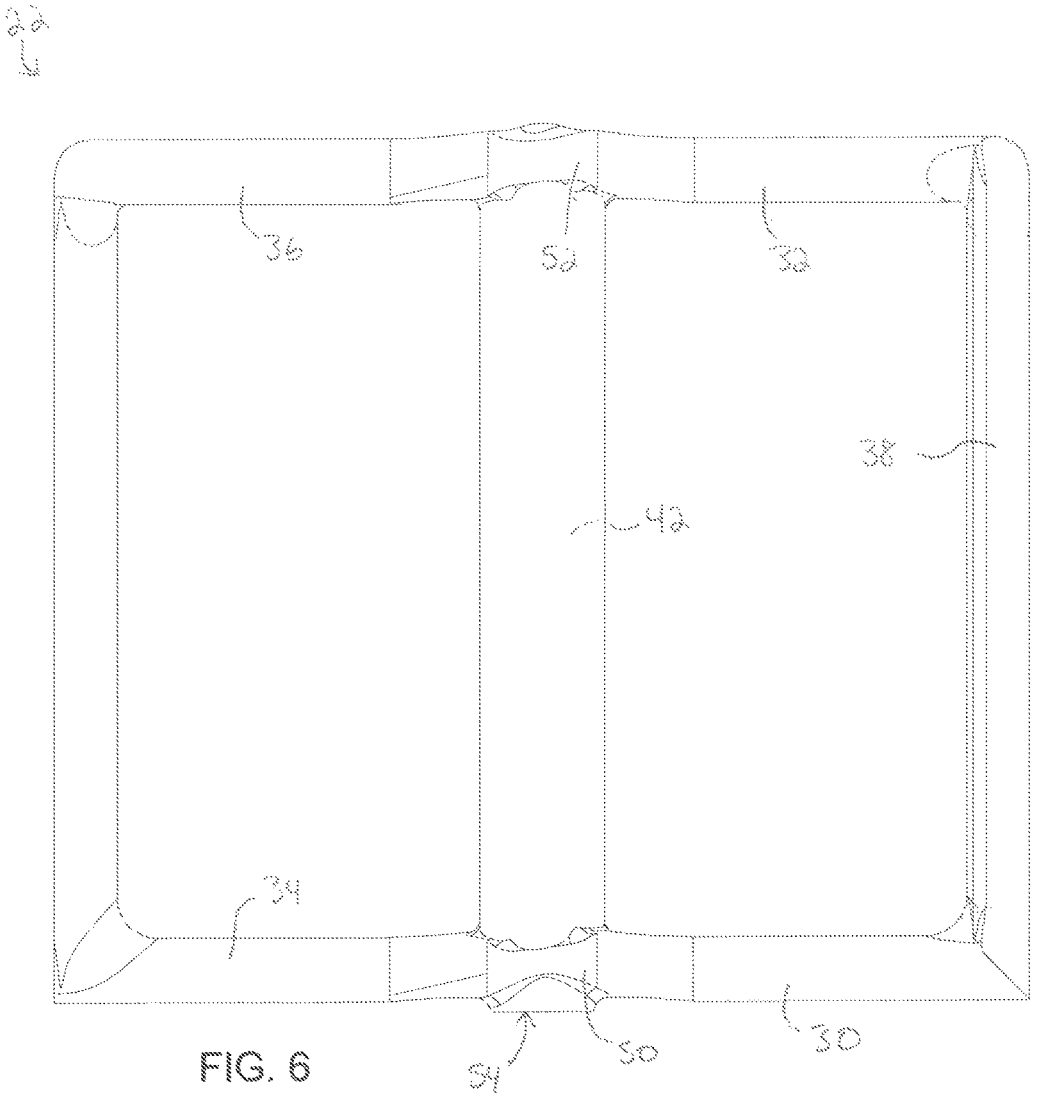
FIG. 6 is a rear view of the blade of FIG. 5.

Turning now to FIGS. 5-6, the blade 22 may include radially extending arms 30, 32, 34, and 36, axially extending walls 38 and 40 extending between corresponding radially extending arms 30, 32, 34, and 36, and radially-central cylindrical support 42. The first radially extending arm 30 and the third radially extending arm 34 may extend from a first radially central portion 50 of the blade 22 toward the corresponding axially extending wall 38 or 40. For example, the first radially extending arm 30 and the third radially extending arm 34 may extend radially outward along a first lateral axis L1 that is perpendicular to the longitudinal axis A. The blade 22 may include more than four radially extending arms 30, 32, 34, and 36 and/or more than two axially extending walls 38 or 40. Alternatively, the blade 22 may include less than four radially extending arms 30, 32, 34, and 36 and/or less than-f two axially extending walls 38 or 40.

The second radially extending arm 32 and the fourth radially extending arm 36 may extend from a second radially central portion 52 of the blade 22—that is axially spaced from the first radially central portion 50—toward the corresponding axially extending wall 38 or 40. For example, the second radially extending arm 32 and the fourth radially extending arm 36 may extend radially outward along a second lateral axis L2 that is perpendicular to the longitudinal axis A and longitudinally offset from the first lateral axis $L_1$.

The radially-central cylindrical support 42 may extend longitudinally from the first radially central portion 50 to the second radially central portion 52. For example, the radially-central cylindrical support 42 may be concentric with the longitudinal axis A for housing the drive end of the shaft 24 (shown in FIGS. 1-4).

The radially-central cylindrical support may have an opening 54 leading to a hole 56 (shown in dashed lines in FIG. 5) that extends toward the second radially central portion 52 along the longitudinal axis A to receive an end of the shaft 24 that is fixed to the radially-central cylindrical support 42. The hole 56 may have a cross-section that matches the cross-section of the shaft 24 so that the radially outer surface of the shaft 24 engages a radially inner surface of the radially-central cylindrical support 42 that forms the hole 56. The engagement of the shaft 24 with the radially-central cylindrical support 42 may allow the shaft 24 to drive the radially-central cylindrical support 42, which may in turn drive the radially extending arms 30, 32, 34, and 36.

The hole 56 may extend through most of the radially-central cylindrical support 42 toward the second radially central portion 52. For example, the second radially central portion 52 may form a protective cover over an axial most end of the drive end of the shaft 24 to prevent the drive end from directly contacting of inner wall of a container while the blade 22 is inside the container.

The radially-central cylindrical support 42 may be fixed to the shaft 24 by any suitable connection, such as by an adhesive and/or by molding the radially-central cylindrical support 42 to the shaft 24. In an embodiment, the opening extends through the entire radially-central cylindrical support to provide maximum support for the shaft. For example, the first radially central portion, the second radially central portion and the radially-central cylindrical portion may together circumscribe the drive end the shaft. In another embodiment, the hole extends through less than half of the radially-central cylindrical support. For example, the first radially central portion and less than half of the radially-central cylindrical portion may together circumscribe the end the shaft.

The opening 54 may be adjacent the first radially central portion 50. For example, the opening 54 and the hole 56 may be concentric with the longitudinal axis A so that a center of the rotation of the shaft is adjacent a radially inward end of the radially extending arms 30, 32, 34, and 36. In an embodiment, the opening may be radially offset from the longitudinal axis.

Figure 7:
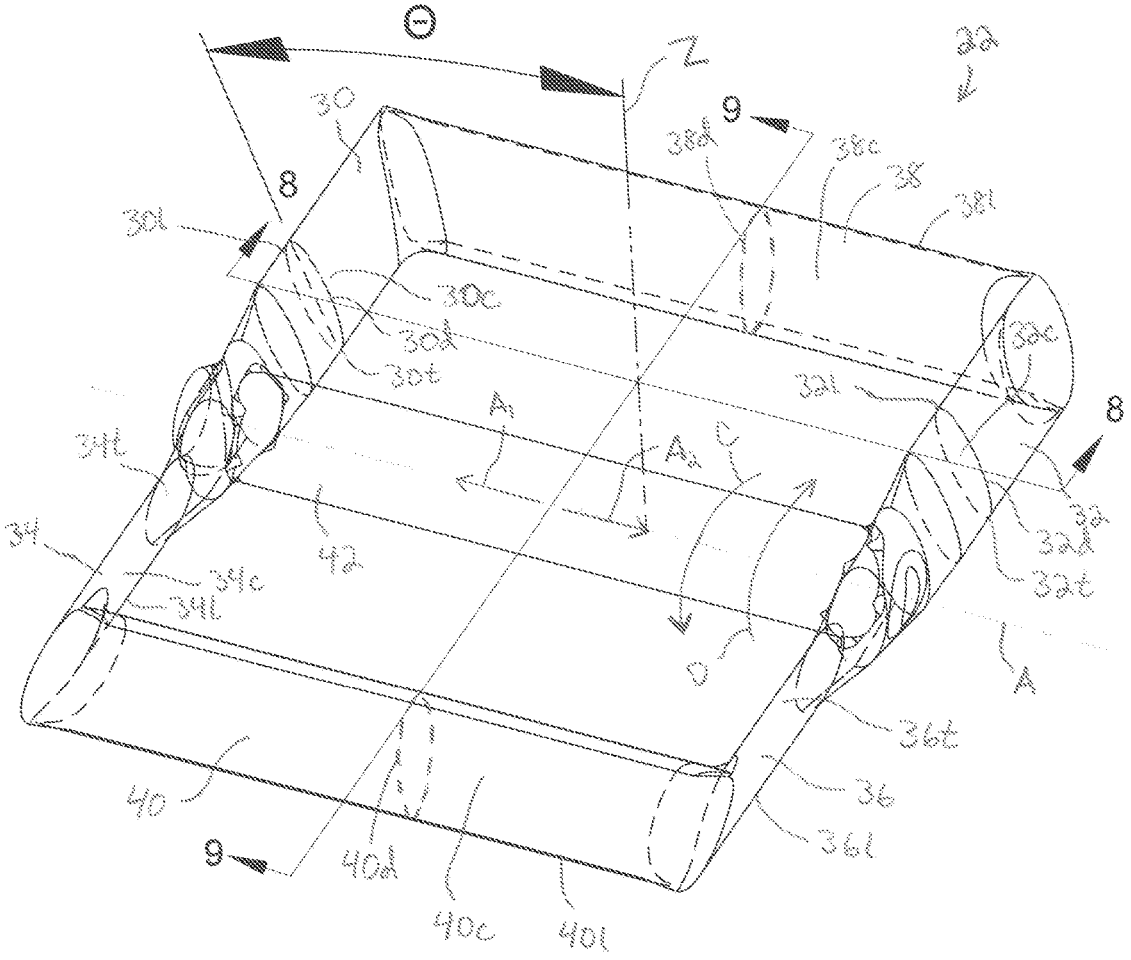
FIG. 7 is an oblique view of front of the blade of FIG. 5 showing an exemplary tilt angle.

Turning now to FIG. 7, the radially extending arms 30, 32, 34, and 36 and the axially extending walls 38 and 40 may have an elliptical cross-section, examples of which are illustrated in dashed lines 30*d*, 32*d*, 38*d*, and 40*d*. In an embodiment, the radially extending arms and/or the axially extending walls have another suitable shape, such as a partially elliptical cross-section.

The first radially extending arm 30 may include a trailing edge 30*t*, a leading edge 30*l*, and a central portion 30*c* between the trailing edge 30*t* and the leading edge 30*l*. For example, at least a portion of the leading edge 30*l* may be thinner than the adjacent central portion 30*c* and/or at least a portion of the trailing edge 30*t* may be thinner than the adjacent central portion 30*c*. The leading edge 30*l* may be able to cut through joint compound when the blade 22 is rotated about the longitudinal axis in a first circumferential direction C. Alternatively, the trailing edge 30*t* may be able to cut through the joint compound when the blade 22 is rotated about the longitudinal axis in direction opposite to the first circumferential direction C.

Similar to the first radially extending arm 30, the second radially extending arm 32 may include a trailing edge 32*t*, a leading edge 32*l*, and a central portion 32*c* between the trailing edge 32*t* and the leading edge 32*l*. The second radially extending arm 32 may be symmetrical with the first radially extending arm 30 relative to a plane transverse to the longitudinal axis A and extending through an axial center of the radially-central cylindrical support 42. For example, the second radially extending arm 32 may be circumferentially aligned with the first radially extending arm 30.

The first axially extending wall 38 may extend from a radially outer end of the first radially extending arm 30 to a radially outer end of the second radially extending arm 32. The first axially extending wall 38 may include a trailing edge 38*t*, a leading edge 381, and a central portion 38*c* between the trailing edge 38*t* and the leading edge 381. For example, the leading edge 381 of the first axially extending wall 38 may be radially offset radially outwardly from the adjacent central portion 38*c* such that rotation of the blade 22 in the first circumferential direction C would urge the joint compound radially inwardly.

At least a portion of the leading edge 38*l* may be thinner than the adjacent central portion 38*c* and/or at least a portion of the trailing edge 38*t* may be thinner than the adjacent central portion 38*c*. The leading edge 38*l* may be able to cut through the joint compound when the blade 22 is rotated about the longitudinal axis in a first circumferential direction C. Alternatively, the trailing edge 38*t* may be able to cut through the joint compound when the blade 22 is rotated about the longitudinal axis in direction opposite to the first circumferential direction C.

The adjacent central portion 38*c* may form a radially inward facing surface that extends between the leading edge 38*l* and the trailing edge 38*t* and faces slightly tangentially to a rotational path of the axially extending wall 38 about the longitudinal axis A. Facing the radially inward facing surface slightly tangential to the rotational path allows the radially inward facing surface to urge the joint compound in the first circumferential direction C when the radially-central cylindrical support 42 rotates in the first circumferential direction C.

The third radially extending arm 34, the fourth radially extending arm 36, and the second axially extending wall 40 may be a mirrored copy of the first radially extending arm 30, the second radially extending arm 32, and the first axially extending wall 38 across a plane extending parallel to the longitudinal axis A. For example, the radially extending arms 34 and 36 and the second axially extending wall 40 may be diametrically opposite the radially extending arms 30 and 32 and the first axially extending wall 38, respectively, relative to the longitudinal axis A.

Similar to the radially extending arms 30 and 32 and the first axially extending wall 38, the radially extending arms 34 and 36 and the second axially extending wall 40 may include a respective trailing edge 34*t*, 36*t*, or 40*t*, a respective leading edge 34*l*, 36*l*, or 40*l*, and a respective central portion 34*c*, 36*c*, or 40*c*.

Figure 10:
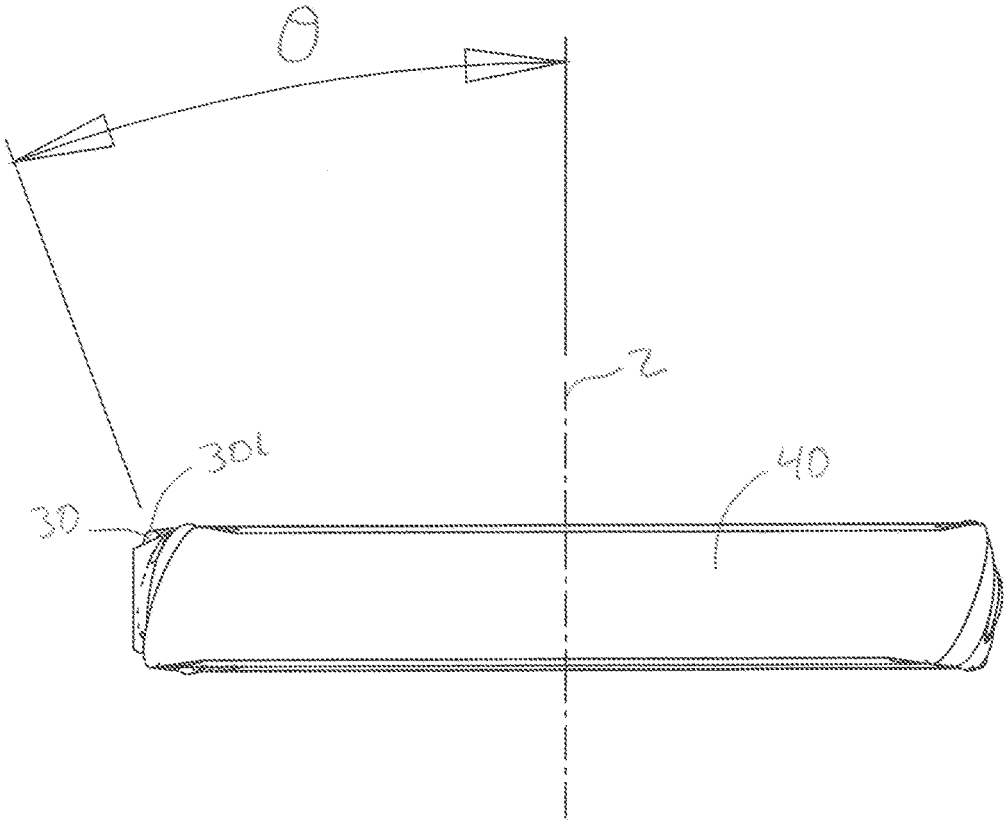
FIG. 10 is a side view of the blade showing the tilt angle of FIG. 7.

Together, the first radially extending arm 30 and the third radially extending arm 34 may have a propeller shape. For example, the leading edge 30*l* and the trailing edge 30*t* may be tilted an angle θ relative to a normal axis Z that is centrally disposed between the dashed lines 30*d* and 32*d* and orthogonal to a plane formed by the longitudinal axis A and the lateral axis $L_1$. The leading edge 30l and the trailing edge 30*t* may be longitudinally offset from one another such that the first radially extending arm 30 is tilted an angle θ (shown best in FIG. 10) relative to the normal axis Z. The angle θ may be 20° or any other suitable angle, such as anywhere between 5° and 45°.

The angle θ may affect the amount of power required to rotate the blade 22. The angle θ may be higher than 20°, which may result in the blade 22 having a relatively higher resistance to rotation. The higher resistance to rotation may require more power to rotate the blade 22 during use. Alternatively, the angle θ may be lower, which may result in the blade 22 having a relatively lower resistance to rotation. The lower resistance to rotation may require more power to rotate the blade 22 during use.

Offsetting the leading edge 30*l* of the first radially extending arm 30 from the adjacent central portion 30*c* and/or the trailing edge 30*t* in a first axial direction $A_1$ allows the first radially extending arm 30 to urge the joint compound in the second axial direction $A_2$ when the blade 22 is rotated. For example, the first radially extending arm 30 may form a surface that extends between the leading edge 30*l* and the trailing edge 30*t* and faces partially in the second axial direction $A_2$ such that rotation of the blade 22 in the first circumferential direction C urges the joint compound in the second axial direction $A_2$.

Similar to the first radially extending arm 30, the third radially extending arm 34 may be tilted an angle −θ relative to an axis orthogonal to a plane formed by the longitudinal axis A and the lateral axis $L_1$ and that is centrally disposed between the radially extending arms 34 and 36. For example, the third radially extending arm 34 may mirror the first radially extending arm 30 across the plane extending parallel to the longitudinal axis A. In an embodiment, the third radially extending arm may be tilted an angle other than −θ, such as any angle between 5° and 45°.

The second radially extending arm 32 and the fourth radially extending arm 36 may similar form a propeller blade shape identical to the propeller blade shape of the first radially extending arm 30 and the third radially extending arm 34. For example, the first radially extending arm 30 and the second radially extending arm 32 may be parallel to one another such the corresponding leading edges 30*l* and 32*l* are axially offset from one another a distance equal to an axial offset of the corresponding trailing edges 30*t* and 32*t*. The third radially extending arm 34 and the fourth radially extending arm 36 may be parallel to one another such the corresponding leading edges 34*l* and 36*l* are longitudinally offset from one another a distance equal to a longitudinal offset of the corresponding trailing edges 34*t* and 36*t*.

In an embodiment, the second radially extending arm is tilted at an angle different than first radially extending arm and/or the fourth radially extending arm is tilted at an angle different than third radially extending arm.

The blade 22 may be entirely made of plastic, such as Acrylonitrile butadiene styrene (ABS). Making the blade 22 of plastic may reduce wear and tear of containers that hold joint compound while being mixed, compared to previously known joint compound mixers made of metal. For example, when the blade 22 rotates within a container with joint compound (not shown) to mix the joint compound, the blade 22 may rub and/or grind against inner walls of the container. The plastic of the blade 22 may wear away significantly less container material compared to previously known metal joint compound mixers. In an embodiment, the blade may be made of any other suitable material.

When the blade 22 and end of the shaft 24 (shown in FIGS. 1-4) are placed into a bucket (not shown) of joint compound, the shaft 24 may be rotated by the driver (not shown) about the longitudinal axis A. Each leading edge 30*l*-40*l* of the radially extending arms 30, 32, 34, and 36 and the axially extending walls 38 and 40 may cut through the joint compound while the blade 22 rotates in the first circumferential direction C. The respective central portions 30*c*-40*c* may then spread the joint compound that the leading edges 30*l*-40*l* cut through. The cutting and spreading effect may provide enhanced mixing of the joint compound compared to previously known joint compound mixers.

Figure 8:
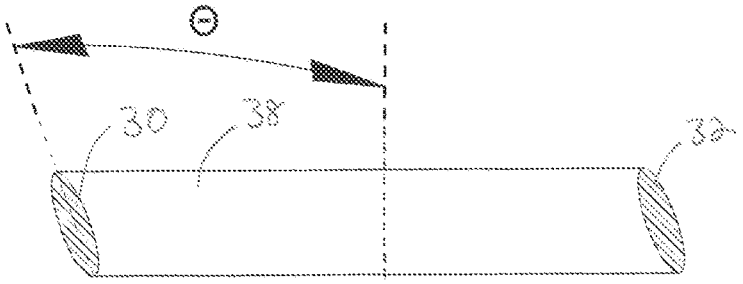
FIG. 8 is a cross-sectional side view of the blade of FIG. 7 including exemplary radially extending arms with an exemplary elliptical cross-section.
Figure 9:
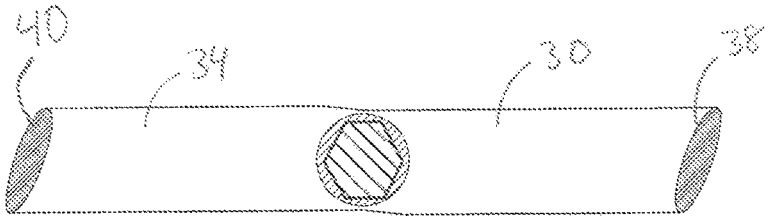
FIG. 9 is a cross-sectional top view of the blade of FIG. 7 including exemplary axially extending walls with an exemplary elliptical cross-section.

While the blade 22 rotates in the joint compound, the joint compound rotation of the blade 22, which may result in mechanical stresses within the blade 22. The elliptical cross section of the radially extending arms 30, 32, 34, and 36 (shown best in FIG. 8 for radially extending arms 30 and 32) and the axially extending walls 38 and 40 (shown best in FIG. 9) may provide enhanced structural strength compared to traditional cross-sectional shapes for previously known joint compound mixers. The enhanced strength may be synergistic with the enhanced mixing of the blade 22, compared to previously known joint compound mixers.

The radially extending arms 30, 32, 34, and 36 and the axially extending walls 38 and 40 may together urge the joint compound in the direction of rotation of the blade 22. For example, when the blade 22 is rotated in the first circumferential direction C the joint compound may be urged in the first circumferential direction C and radially inward. When the blade 22 is driven in a second circumferential direction D opposite the first circumferential direction C, the joint compound may be urged in the second circumferential direction D and radially outward.

The radially extending arms 30, 32, 34, and 36 may together urge the joint compound axially. For example, when the blade 22 is rotated in the first circumferential direction C the joint compound may be urged in the second axial direction A2 away from the driven end of the shaft 24. When the blade 22 is driven in the second circumferential direction D, the joint compound may be urged in the first axial direction A1 opposite the second axial direction A2 toward the driven end of the shaft 24.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A mixing device, including:

a blade extending along a longitudinal axis, including:

a first radially extending arm extending from a first radially central portion of the blade, wherein the first radially extending arm has an elliptical cross-section that has a first major axis and a first minor axis, and wherein the elliptical cross-section of the first radially extending arm includes a first trailing edge, a first leading edge, and a first central portion between the first trailing edge and the first leading edge;

a second radially extending arm extending from a second radially central portion of the blade that is longitudinally spaced from the first radially central portion, wherein the second radially extending arm has an elliptical cross-section that has a second major axis and a second minor axis, and wherein the elliptical cross-section of the second radially extending arm includes a second trailing edge, a second leading edge, and a second central portion between the second trailing edge and the second leading edge;

a first axially extending wall extending from a radially outer end of the first radially extending arm to a radially outer end of the second radially extending arm, wherein the first axially extending wall has an elliptical cross-section that has a third major axis and a third minor axis, and wherein the elliptical cross-section of the first axially extending wall includes a third trailing edge, a third leading edge, and a third central portion between the third trailing edge and the third leading edge;

a third radially extending arm extending from the first radially central portion of the blade, wherein the third radially extending arm has an elliptical cross-section that has a fourth major axis and a fourth minor axis, and wherein the elliptical cross-section of the third radially extending arm includes a fourth trailing edge, a fourth leading edge, and a fourth central portion between the fourth trailing edge and the fourth leading edge;

a fourth radially extending arm extending from the second radially central portion of the blade, wherein the fourth radially extending arm has an elliptical cross-section that has a fifth major axis and a fifth minor axis, and wherein the elliptical cross-section of the fourth radially extending arm includes a fifth trailing edge, a fifth leading edge, and a fifth central portion between the fifth trailing edge and the fifth leading edge; and a second axially extending wall extending from a radially outer end of the third radially extending arm to a radially outer end of the fourth radially extending arm, wherein the second axially extending wall has an elliptical cross-section that has a sixth major axis and a sixth minor axis, and wherein the elliptical cross-section of the second axially extending wall includes a sixth trailing edge, a sixth leading edge, and a sixth central portion between the sixth trailing edge and the sixth leading edge;

wherein each leading edge is able to cut through a fluid to be mixed when the blade is rotated about the longitudinal axis in a first circumferential direction, and at least a portion of each leading edge is thinner than each adjacent central portion; and wherein each elliptical cross-section is longer along the corresponding major axis than along the corresponding minor axis.

2. The mixing device of claim 1, wherein the majority of each radially extending arm has an elliptical cross-section, and wherein the majority of each axially extending wall has an elliptical cross-section.

3. The mixing device of claim 1, wherein the leading edges of the first radially extending arm and the second radially extending arm are longitudinally offset from the adjacent central portions in a first axial direction; and wherein rotation of the blade in the first circumferential direction would cause the first radially extending arm and the second radially extending arm to primarily urge a fluid in a second axial direction opposite the first axial direction.

4. The mixing device of claim 3, wherein the first radially extending arm and the second radially extending arm are parallel to one another, and wherein the corresponding leading edges are longitudinally offset from one another a distance equal to an axial offset of the corresponding trailing edges.

5. The mixing device of claim 3, wherein the leading edges of the third radially extending arm and the fourth radially extending arm are longitudinally offset from the adjacent central portions in the first axial direction, and wherein rotation of the blade in the first circumferential direction would cause the third radially extending arm and the fourth radially extending arm to primarily urge a fluid in the second axial direction.

6. The mixing device of claim 5, wherein the third radially extending arm and the fourth radially extending arm are parallel to one another, and wherein the corresponding leading edges are longitudinally offset from one another a distance equal to an axial offset of the corresponding trailing edges.

7. The mixing device of claim 1, wherein the first radially extending arm is diametrically opposite the third radially extending arm relative to the longitudinal axis and/or the second radially extending arm is diametrically opposite the fourth radially extending arm relative to the longitudinal axis.

8. The mixing device of claim 1, wherein the first radially extending arm is circumferentially aligned with the second radially extending arm and/or the third radially extending arm is circumferentially aligned with the fourth radially extending arm.

9. The mixing device of claim 1, wherein the third leading edge of the first axially extending wall is radially offset radially outwardly from the adjacent third central portion, and wherein rotation of the blade in the first circumferential direction would cause the first axially extending wall to primarily urge a fluid radially inwardly; and/or wherein the sixth leading edge of the second axially extending wall is radially offset radially outwardly from the adjacent sixth central portion, and wherein rotation of the blade in the first circumferential direction would cause the second axially extending wall to primarily urge a fluid radially inwardly.

10. The mixing device of claim 1, wherein the first radially extending arm and the third radially extending arm extend radially outward along a first lateral axis that is perpendicular to the longitudinal axis.

11. The mixing device of claim 10, wherein the second radially extending arm and the fourth radially extending arm extend radially outward along a second lateral axis that is perpendicular to the longitudinal axis and longitudinally offset from the first lateral axis.

12. The mixing device of claim 1, wherein the blade is entirely made of plastic.

13. The mixing device of claim 1, further including a shaft with a portion circumscribed by the first radially central portion of the blade.

14. The mixing device of claim 13, wherein the blade is molded to the shaft.

15. The mixing device of claim 1, wherein the blade includes a radially-central support that extends axially from the first radially central portion of the blade to the second radially central portion.

16. The mixing device of claim 1, wherein the majority of each radially extending arm and each axially extending wall has an elliptical cross-section;

wherein the leading edge of each radially extending arm is longitudinally offset from the adjacent central portion in a first axial direction, and wherein rotation of the blade in the first circumferential direction would cause each radially extending arm to primarily urge a fluid in a second axial direction opposite the first axial direction;

wherein the first radially extending arm and the second radially extending arm are parallel to one another and the corresponding leading edges are longitudinally offset from one another a distance equal to an axial offset of the corresponding trailing edges, and wherein the third radially extending arm and the fourth radially extending arm are parallel to one another and the corresponding leading edges are longitudinally offset from one another a distance equal to an axial offset of the corresponding trailing edges;

wherein the first radially extending arm is diametrically opposite the third radially extending arm relative to the longitudinal axis, and wherein the second radially extending arm is diametrically opposite the fourth radially extending arm relative to the longitudinal axis;

wherein the first and third radially extending arms are circumferentially aligned with the second and fourth radially extending arms, respectively;

wherein the leading edge of each axially extending wall is radially offset radially outwardly from the adjacent central portion such that rotation of the blade in the first circumferential direction would urge a fluid radially inwardly;

wherein the first radially extending arm and the third radially extending arm extend radially outward along a first lateral axis that is perpendicular to the longitudinal axis, and wherein the second radially extending arm and the fourth radially extending arm extend radially outward along a second lateral axis that is perpendicular to the longitudinal axis and longitudinally offset from the first lateral axis; and wherein the entire blade has a blade thickness along a normal axis, perpendicular to the first lateral axis and the longitudinal axis, equal to the thickness of the radially extending arms and the axially extending walls along the normal axis.

17. The mixing device of claim 16, further including a shaft connected to an axial end of the blade, wherein the blade is molded to the shaft;

wherein the blade is entirely made of plastic;

wherein the blade includes a radially-central cylindrical support that extends axially from the first radially central portion of the blade to the second radially central portion, wherein the radially-central cylindrical support has an opening adjacent the first radially central portion of the blade.

18. A mixing device, including:

a blade extending along a longitudinal axis, including:

a radially extending arm extending from a first radially central portion of the blade, wherein the radially extending arm includes a first trailing edge, a first leading edge, and a first central portion between the first trailing edge and the first leading edge; and an axially extending wall permanently fixed relative to and extending from a radially outer end of the radially extending arm, wherein the axially extending wall includes a second trailing edge, a second leading edge, and a second central portion between the second trailing edge and the second leading edge;

wherein the majority of the radially extending arm has an elliptical cross-section that has a first major axis and a first minor axis, wherein the elliptical cross-section of the radially extending arm is longer along the first major axis than the first minor axis and forms the first trailing edge, the first leading edge, and the first central portion, and wherein the first leading edge of the radially extending arm is able to cut through a fluid to be mixed when the blade is rotated about the longitudinal axis in a first circumferential direction, and at least a portion of the first leading edge of the radially extending arm is thinner than the adjacent first central portion of the radially extending arm; or wherein the majority of the axially extending wall has an elliptical cross-section that has a second major axis and a second minor axis, wherein the elliptical cross-section of the axially extending wall is longer along the second major axis than the second minor axis and forms the second trailing edge, the second leading edge, and the second central portion, and wherein the second leading edge of the axially extending wall is able to cut through a fluid to be mixed when the blade is rotated about the longitudinal axis in a first circumferential direction, and at least a portion of the second leading edge of the axially extending wall is thinner than the adjacent second central portion of the axially extending wall.

19. A mixing device, including:

a blade extending along a longitudinal axis, including:

a first radially extending arm extending from a first radially central portion of the blade, wherein the majority of the first radially extending arm has an elliptical cross-section that has a first major axis and a first minor axis, wherein the elliptical cross-section of the first radially extending arm includes a first trailing edge, a first leading edge, and a first central portion between the first trailing edge and the first leading edge; and a second radially extending arm extending from a second radially central portion of the blade that is longitudinally spaced from the first radially central portion, wherein the majority of the second radially extending arm has an elliptical cross-section that has a second major axis and a second minor axis, and wherein the elliptical cross-section of the second radially extending arm includes a second trailing edge, a second leading edge, and a second central portion between the second trailing edge and the second leading edge;

wherein each leading edge is able to cut through a fluid to be mixed when the blade is rotated about the longitudinal axis in a first circumferential direction, and at least a portion of the leading edge of each radially extending arm is thinner than the adjacent central portion of the corresponding radially extending arm;

wherein the first radially extending arm is circumferentially aligned with the second radially extending arm; and wherein each elliptical cross-section is longer along the corresponding major axis than along the corresponding minor axis.

20. The mixing device of claim 19, wherein the first radially extending arm extends along a first lateral axis perpendicular to the longitudinal axis, and the second radially extending arm extends along a second lateral axis parallel to the first lateral axis; and wherein the entire blade has a blade thickness along a normal axis, perpendicular to the first lateral axis and the longitudinal axis, equal to the thickness of the radially extending arms along the normal axis.

* * * * *